United States Patent [19]

Pecile et al.

[11] Patent Number: 4,829,213

[45] Date of Patent: May 9, 1989

[54] FLAT ELECTROLUMINESCENT SCREEN

[76] Inventors: Dario Pecile, 29 rue E. Lefebre, 95430 Auvers Sur Oise; Roger Menn, 17 rue Latour Prolongee, 60140 Liancourt; Christian Brunel, 5, rue Molière, 92120 Montrouge, all of France

[21] Appl. No.: 83,586

[22] Filed: Aug. 10, 1987

[30] Foreign Application Priority Data

Aug. 11, 1986 [FR] France ..... 86 11585

[51] Int. Cl.[4] ..... H05B 33/09

[52] U.S. Cl. ..... 313/509; 313/512; 340/825.81

[58] Field of Search ..... 313/505, 506, 509, 512; 315/169.3; 340/781, 825.81

[56] References Cited

U.S. PATENT DOCUMENTS

B361,347 1/1975 Coderre et al. .
3,531,585 10/1970 Strain .
3,673,450 6/1972 Leach .

FOREIGN PATENT DOCUMENTS 2063544 6/1981 United Kingdom .

*Primary Examiner*—David K. Moore
*Assistant Examiner*—Sandra L. O'Shea
*Attorney, Agent, or Firm*—Pearne, Gordon, McCoy & Granger

[57] ABSTRACT

A flat electroluminescent screen comprising a transparent substrate on which are successively deposited a first group of parallel electrodes, said electrodes being transparent, a layer constituted by an electroluminescent material inserted between two dielectric layers and a second group of parallel electrodes, the two groups of electrodes intersecting and defining in the electroluminescent layer a plurality of optical emitters arranged in matrix form, said flat screen also comprising a control circuit for the first electrodes, a control circuit for the second electrodes and a protective counter-plate sealed on said substrate by a sealing band. On its inner face, the counter-plate carries at least one counter-electrode and means are provided so that each counter-electrode is electrically connected to the two ends of an electrode of the substrate.

9 Claims, 6 Drawing Sheets

FLAT ELECTROLUMINESCENT SCREEN

BACKGROUND OF THE INVENTION

The present invention relates to a flat electroluminescent screen or panel. Such a screen makes it possible to display a large quantity of graphic and/or alphanumeric informations and is used as a visual display terminal in portable computers, in telematic terminals, such as the Minitel, or as a television screen.

Conventionally, an electroluminescent screen comprises a substrate on which are stacked layers of electrically conductive materials, electrically insulating layers and a layer of an electroluminescent material, said layers being protected by a counter-plate covering the substrate. Such an electroluminescent screen or panel is more particularly described in the article "Practical application technologies of thin-film electroluminescent panels" by Mikio Takeda et al, published in the Proceedings of the SID, vol. 22-1, 1981, pp 57 to 62. FIG. 1 is a sectional view of an electroluminescent screen according to this article.

The different active layers of the screen are deposited on a transparent glass substrate. Deposition firstly takes place of a conductive layer, e.g. of $In_2O_3$, which is then etched to form a network of parallel electrodes 4. This is followed by the successive deposition of a first dielectric layer 6, an electroluminescent layer 8 and a second dielectric layer 10. The dielectric layers are e.g. of $Si_3N_4$ and the electroluminescent layer of ZnS:Mn.

The second series of electrodes 14 is then etched in a conductive layer deposited on the second dielectric layer. An anchoring layer 12, e.g. of $Al_2O_3$, can be positioned between layer 10 and electrodes 14 in order to facilitate the anchoring or attachment thereof.

Finally, the circuit is protected against mechanical action and moisture by a glass counter-plate 18 fixed to substrate 2 by a sealing band 20, the free space between the deposited layers and the counter-plate 18 being previously filled with a filling material 16, such as a silicone oil.

Each intersection between an electrode 4 and an electrode 14 defines an image element constituted by superimposing the first dielectric layer, the electroluminescent material and the second dielectric layer. The two networks of electrodes 4 and 14 thus define a matrix of electroluminescent elements.

An image element has a certain fragility. Thus, it is not uncommon for an electric breakdown to occur in an image element, which generally brings about a deterioration of at least one of the two control electrodes associated with said element. Thus, the deteriorated electrode portion located beyond the breakdown zone is no longer supplied. The image elements associated with said electrode portion can then no longer be addressed and thus no longer emit light.

Thus, a breakdown in an image element leads to a display fault on a row or column portion of the display. As this fault is not acceptable, methods have been proposed to prevent the deterioration of electrodes when an electric breakdown occurs in an image element.

A first solution is proposed in the article "Thin-film electroluminescent displays produced by atomic layers" by T. Sutela published in the journal Displays, April 1984, pp 73 to 78. This method consists of making short incisions in the electrodes parallel to the direction thereof and level with each image element. The function of these incisions is to stop the propagation of electric breakdowns, in accordance with a principle identical to that of a firebreak in a forest.

This method suffers from the disadvantage of reducing the emissive surface, because the anti-propagation incisions have a non-negligible width of approximately 10 to 20 microns and must be numerous in order to be effective.

A method making it possible to reduce the number of electric breakdowns is also described in GB-A-2096814. This method consists of applying a writing compensation pulse before the refreshing pulse and a refreshing compensation pulse after the refreshing pulse and before the following writing pulse. These compensation pulses have opposite signs to the writing and refreshing pulses and their intensity is sufficiently low not to act on the image elements.

The two known methods described hereinbefore aim at reducing the number of electric breakdowns or the effect of an electric breakdown on an electrode. However, these methods do not provide any solution as soon as an electrode has been damaged. Thus, they do not obviate a display fault on the electrode portion beyond the deteriorated portion.

The object of the invention is to make it possible to continue to control the display of the image elements located beyond the deteriorated portion of the electrode, i.e. to limit the display fault to the single image element destroyed by the electric breakdown.

To achieve this objective, the invention proposes etching counter-electrodes on the inner face of the protective counter-plate and to connect each counter-electrode to the two ends of a control electrode of the electroluminescent screen.

In this way, the control electrodes are supplied by their two ends. Thus, when a breakdown appears on a control electrode, as a result of the electric breakdown of an image element, the electrode portion beyond the breakdown continues to be supplied or energized.

All the image elements, except that where the electric breakdown has appeared are then supplied. Thus, the display fault remains limited to a single image element, which can virtually not be detected by an observer.

SUMMARY OF THE INVENTION

The present invention specifically relates to a flat electroluminescent screen comprising a transparent substrate, a first group of parallel row electrodes etched on said substrate, said electrodes being transparent, a layer of an electroluminescent material inserted between two dielectric layers, a second group of parallel column electrodes etched on said dielectric layer, the two groups of electrodes intersecting and defining in the electroluminescent layer a plurality of matrix-arranged optical emitters, and a protective counter-plate sealed on said substrate, wherein the counter-plate carries on its inner face at least one counter-electrode and wherein means are provided so that each counter-electrode is electrically connected to the two ends of the same electrode of the first or second groups of electrodes.

According to a special embodiment, the protective counter-plate carries on its inner face a group of parallel counter-electrodes partly covered by an electrically insulating layer, each counter-electrode being connected to the two ends of an electrode of the first group of electrodes and is insulated from the electrodes of the second group of electrodes by said electrically insulating layer.

According to another preferred embodiment, the counter-plate carries on its inner face a group of parallel counter-electrodes, each counter-electrode being electrically connected to an electrode of the second group of electrodes.

According to another advantageous embodiment, the counter-plate carries on its inner face a first group of counter-electrodes, an electrically insulating layer and a second group of counter-electrodes, the first and second groups of counter-electrodes intersecting, each counter-electrode of the first group of counter-electrodes being electrically connected to the two ends of an electrode of the first group of electrodes and each counter-electrode of the second group of counter-electrodes is electrically connected to the two ends of an electrode of the second group of electrodes.

In preferred manner, the electrical contact between an electrode and a counter-electrode is obtained, at each end of said electrode, by a conducting piece or stud, which can e.g. be produced with the aid of a conductive ink deposited by screen process printing.

The invention can also be realized in the case of a double screen comprising two substrates assembled together, each substrate carrying a first group of parallel electrodes, a plurality of layers constituting the electroluminescent elements and a second group of parallel electrodes, the electrodes of the first and second groups intersecting, assembly being carried out in such a way as to electrically connect the two ends of an electrode of the second group of electrodes of one substrate to the two ends of an electrode of the second group of electrodes of the other substrate.

BRIEF DESCRIPTION OF THE DRAWINGS

The invention is described in greater detail hereinafter relative to non-limitative embodiments and the attached drawings, wherein show.

FIG. *7a* The structure of an electroluminescent screen, whose lines are coded pairwise and FIG. *7b* illustrates the same screen having a counter-plate according to the invention.

DETAILED DESCRIPTION OF THE PREFERRED EMBODIMENTS

A description will now be given of a first embodiment of an electroluminescent screen or panel according to the invention with reference to FIGS. 2 and 3.

The electroluminescent screen comprises a transparent substrate 2 on which is formed the matrix of electroluminescent elements, as well as a counter-plate 18. These two members will subsequently be assembled.

Figure 1:
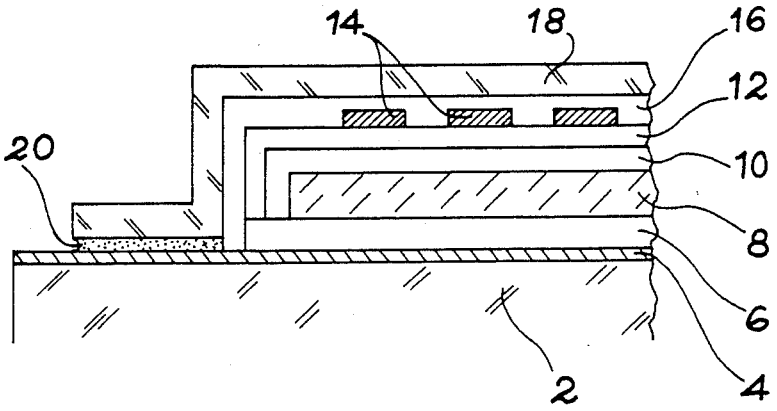
FIG. 1, already described, a sectional view of a known electroluminescent screen.

The matrix of electroluminescent elements is produced in conventional manner on substrate 2, e.g. as described relative to FIG. 1. A first conductive layer is deposited and then etched, so as to form a first group of parallel electrodes 4. These electrodes are transparent and are e.g. made from indium-tin oxide. These electrodes are covered by a first dielectric layer 6, an electroluminescent material layer 8 and a second dielectric layer 10 (FIG. 3). The assembly of these three layers is represented by a single layer 22 in FIG. 2. The dielectric layers are e.g. of $Si_3N_4$ and the electroluminescent layer of ZnS:Mn.

Layer 22 is covered by a conductive layer in which is etched a second group of electrodes 14. The latter electrodes are not necessarily transparent and are e.g. made from aluminium. Between layer 22 and electrodes 14 can be deposited an attachment or anchoring underlayer of $Al_2O_3$ to permit better contact between electrodes 14 and layer 22. In the embodiment of FIG. 2, the control circuits 24, 26 of the first and second groups of electrodes are also produced on substrate 2.

In conventional manner, a counter-plate 18 is added in order to provide a mechanical protection and a protection against moisture for layer 22. A sealing band 20 provides the necessary fixing between substrate 2 and counter-plate 18. In the represented embodiment, said sealing band is produced on counter-plate 18. However, it can also be produced on substrate 2.

According to the invention, counter-plate 18 carries at least one etched counter-electrode for connecting to the two ends of one electrode of substrate 2. In the represented embodiment, the counter-plate 18 carries in exemplified manner a group of parallel counter-electrodes 28, which are e.g. made from aluminium. These counter-electrodes 28 can be etched in a layer deposited directly on counter-plate 18. It is also possible to deposit beforehand on counter-plate 18, an $Al_2O_3$ anchoring layer, or a layer made from $SiO_2$ constituting a chemical barrier.

Counter-electrodes 28 are to be connected to the electrodes 14 etched on substrate 2. This connection is made by a group of conductive studs 30 produced on counter-electrodes 28. A conductive ink deposited by screen process printing can be used for producing these conductive studs. This procedure has the advantage of being easy to perform and inexpensive.

For example, it is possible to use an ink of the epoxy resin type with two polymerization states, such as ink EPO-TEK WE-12. In this case, the deposited ink is firstly dried at 90° C. for 90 minutes to obtain a first polymerized state, which permits storage for several months at ambient temperature.

Sealing band 20 can also be produced by means of an ink deposited by screen process printing, such as ink EPO-TEK H78. This ink is dried in the same way as that used for producing conductive studs 30.

The assembly of substrate 2 and counter-plate 18 e.g. takes place in a glove box under a dry gas flow. The precise positioning of counter-plate 18 relative to substrate 2 is obtained by bringing about coincidence between two marks 32 and 36 on substrate 2 respectively with the marks 34, 38 on counter-plate 18.

Finally, in the case of the aforementioned inks for producing the conductive studs and the sealing band, the polymerization of said inks is obtained by heating for 15 minutes at 150° C. Heating for polymerizing inks can be localized, if the other elements of the screen are not designed to withstand such a temperature.

Figure 2:
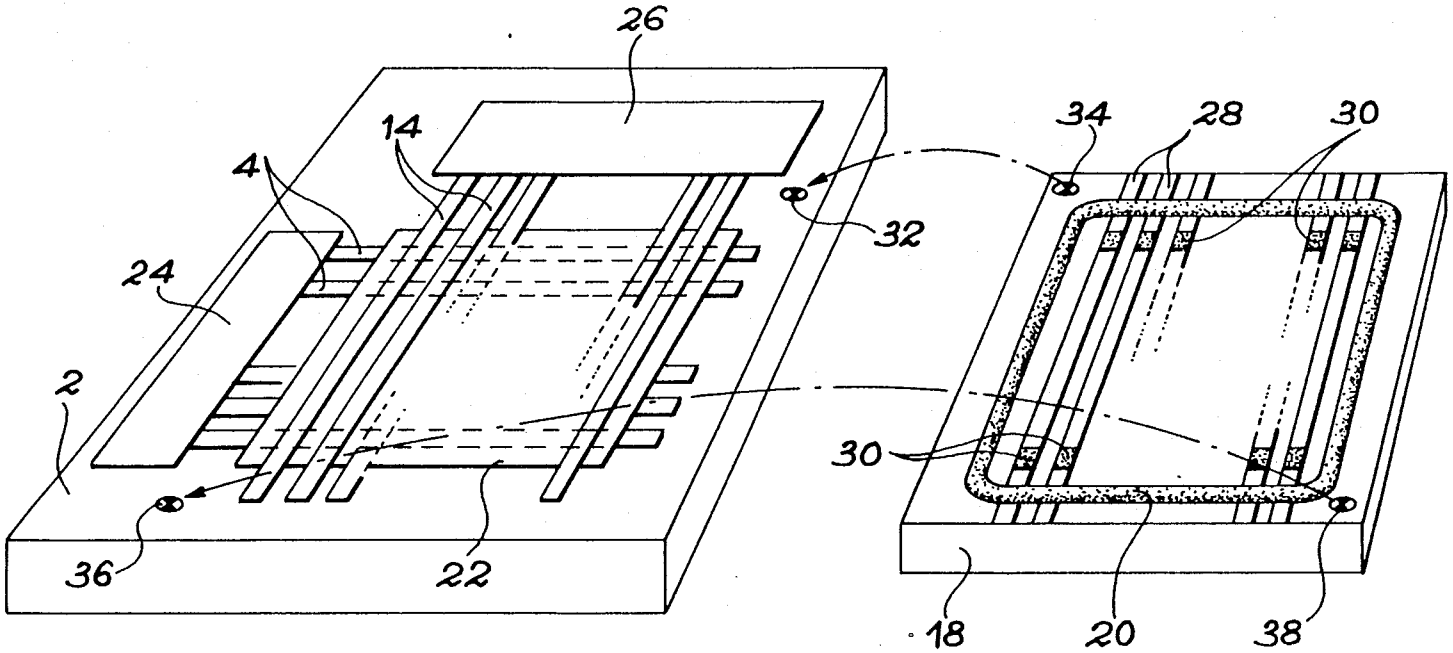
FIG. 2 An embodiment of an electroluminescent screen according to the invention, in which the counter-plate carries a group of counter-electrodes.
Figure 3:
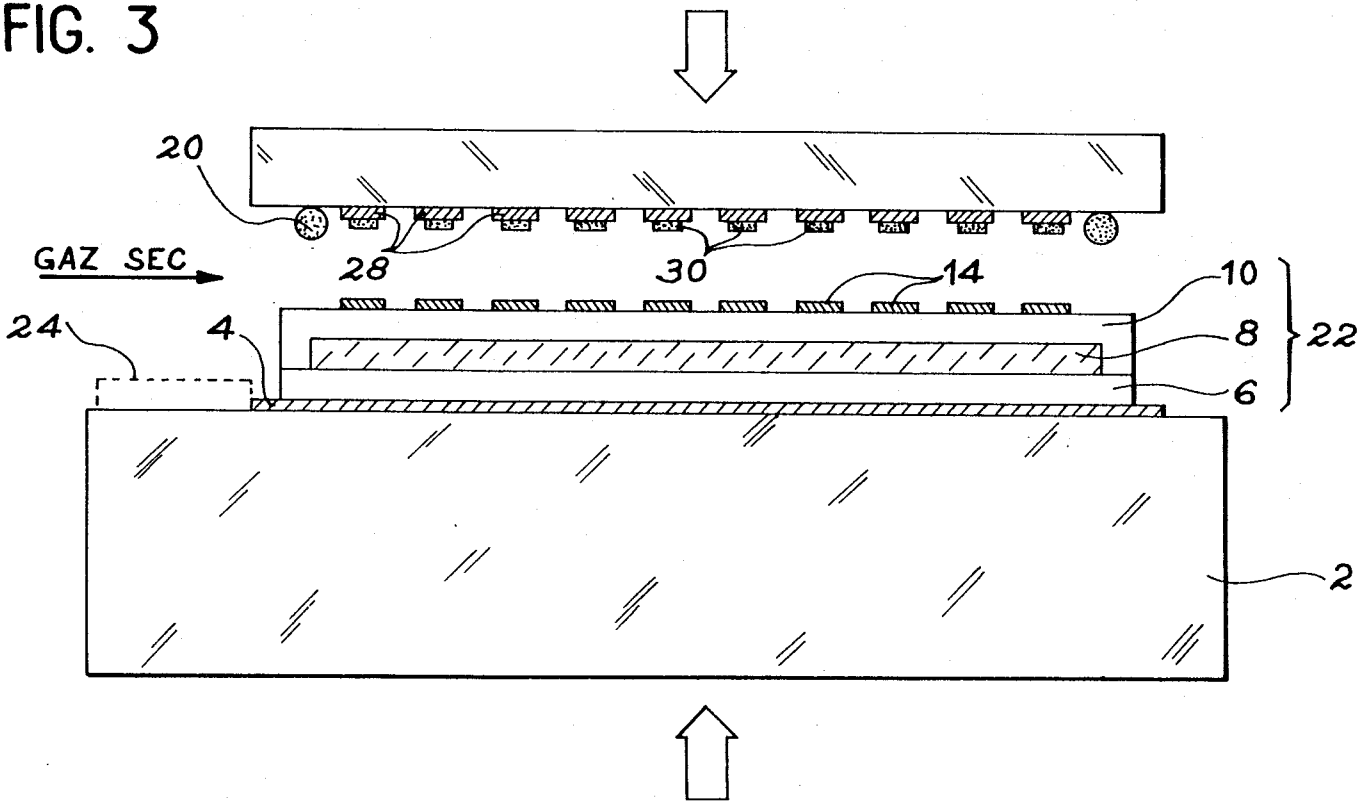
FIG. 3 A sectional view of the electroluminescent screen of FIG. 2 at the time of assembling the substrate and the counter-plate.

Although FIGS. 2 and 3 have shown the conductive pieces or studs and the sealing band on counter-plate 18, it is obvious that these members can also be deposited on substrate 2, or can be distributed over substrate 2 and counter-plate 18.

Figure 4:
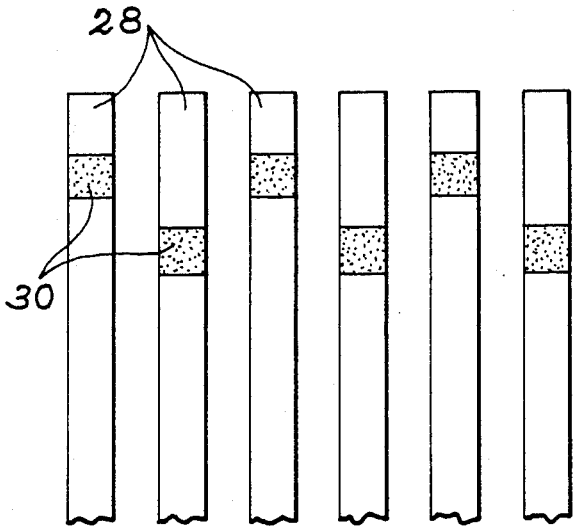
FIG. 4 An advantageous arrangement of the conductive studs to prevent an electric contact between two adjacent electrodes.

During the assembly of substrate 2 and counter-plate 18, the conductive studs 30 are crushed between a counter-electrode 28 and an electrode 14 of the second group of electrodes of substrate 2. This crushing of the studs can bring about an electrical contact between two adjacent counter-electrodes or two electrodes. To obviate this disadvantage, the conductive studs can be arranged in the manner shown in FIG. 4, where the studs of consecutive counter-electrodes 28 are reciprocally displaced.

The addition of counter-electrodes to counter-plate 18 according to the invention makes it possible to supply each electrode 14 by its two ends. Thus, in the case of a local cutting off of an electrode 14, e.g. as a result of an electric breakdown, to continue to supply the electrode portion located beyond the cutting off point.

Moreover, as each electrode 14 is supplied or energized by its two ends, it is possible to reduce the time constant effects, which are particularly sensitive for large screens and which result from the resistance of the electrodes. In the same way, the supply of an electrode by its two ends has the effect of reducing the current peaks, which makes it possible to increase the life of the electroluminescent screen.

In the embodiment of FIGS. 2 and 3, counter-plate 18 carries a group of counter-electrodes 28 to be connected to the electrodes 14 of substrate 2. These electrodes constitute the upper layer of substrate 2, so that there can be contact directly between the same and counter-electrodes 28.

A variant of this embodiment consists of replacing counter-electrodes 28 by another group of electrodes to be connected to the electrodes 4 of substrate 2. In this case, the counter-electrodes must be covered with an electrically insulating layer to prevent any contact with electrodes 14 during the assembly between substrate 2 and counter-plate 18.

As two ends of electrodes 4 are supplied, the same advantages are obtained as when supplying the two ends of electrodes 14 and as described relative to FIGS. 2 and 3, namely a reduction of the time constant effects and a reduction of current peaks. The supply of electrodes 4 by their two ends is of particular interest, because these electrodes have a limited thickness (they must be transparent and cause no step effect) and thus have a high electrical resistance.

Figure 5:
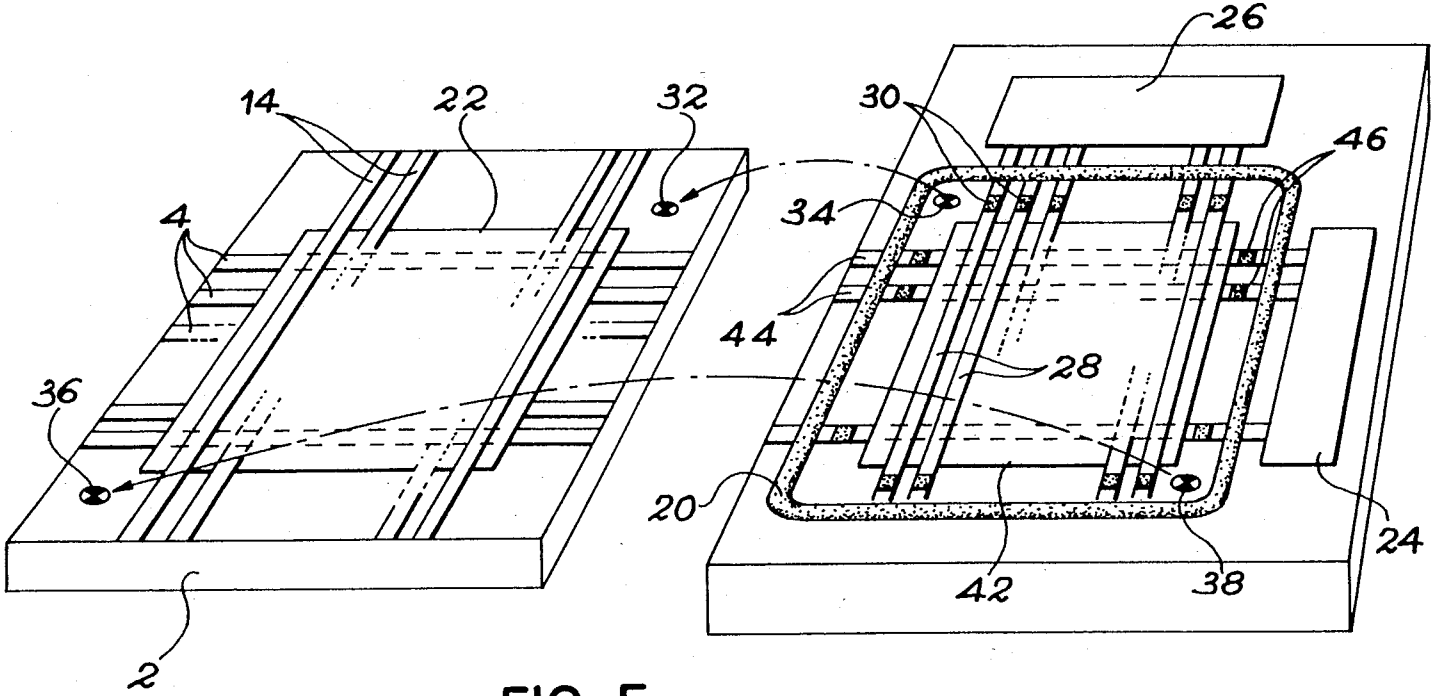
FIG. 5 An electroluminescent screen according to the second embodiment of the invention, in which the counter-plate carries two groups of intersecting counter-electrodes.

Another variant comprises producing simultaneously on counter-plate 18 two groups of intersecting counter-electrodes, each of which is to be connected to one of the two groups of electrodes of substrate 2. Such an embodiment is shown in FIG. 5. The elements identical to those of FIG. 2 carry the same references. The matrix of electroluminescent elements is produced on substrate 2 with the aid of a first group of parallel electrodes 4, a layer 22 constituted by a first dielectric layer, an electroluminescent material layer and a second dielectric layer, as well as a second group of parallel electrodes 14, the electrodes of the two groups intersecting.

According to the invention, counter-electrodes are etched on counter-plate 18. More specifically, in the embodiment of FIG. 5, counter-plate 18 has a first group of parallel counter-electrodes 44 for connection to the electrodes 4 of substrate 2, an electrically insulating layer 14 made e.g. from $Al_2O_3$, $Y_2O_3$, $Ta_2O_5$ or the like (in particular an insulating paste which can undergo screen process printing).

A second group of parallel counter-electrodes 28 is then etched in a conductive layer deposited on layer 42. These counter-electrodes 28 are to be electrically connected to electrodes 14 of substrate 2.

Layer 42 makes it possible to electrically insulate the two groups of counter-electrodes etched on counter-plate 18, whereby the deposition of each conductive layer in which the counter-electrodes are etched can be preceded by the deposition of an anchoring underlayer, e.g. of $Al_2O_3$, or a layer constituting a chemical barrier, e.g. of $SiO_2$, $Si_3N_4$ or the like.

On each counter-electrode 28, 44 are produced two conductive pieces or studs 30, 46 for connecting each of the said counter-electrodes to the two ends of the corresponding electrode of substrate 2. These conductive studs can be produced by means of a conductive ink deposited by screen process printing. The same method can be used for producing the sealing band 20 from a non-electrically conductive ink.

The control circuits 24, 26 of the groups of electrodes 4 and 14 can be produced independently on substrate 2 or on counter-plate 18. The realization on counter-plate 18 can offer an advantage for the operating test prior to assembly. Thus, in this embodiment, the electroluminescence and addressing functions of the electroluminescent elements are respectively performed on substrate 2 and on counter-plate 18 and can consequently be separately tested.

Figure 6:
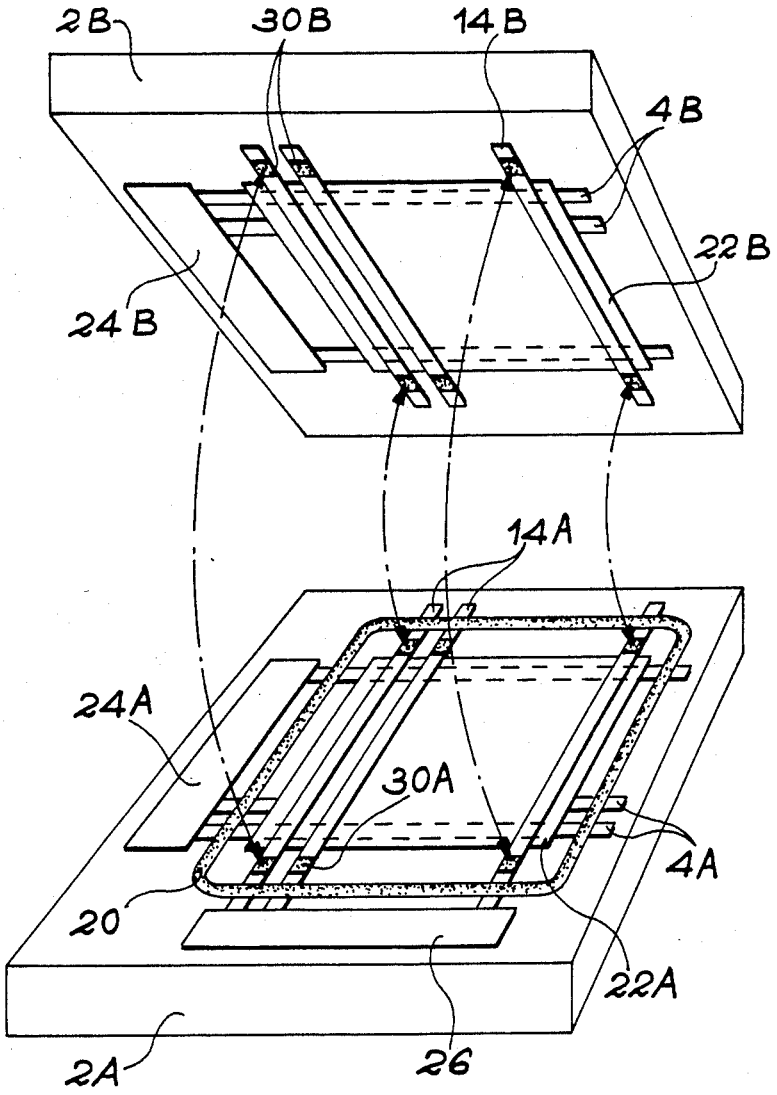
FIG. 6 An embodiment of an electroluminescent screen according to the invention comprising two matrixes of electroluminescent image elements.
Figure 7A:
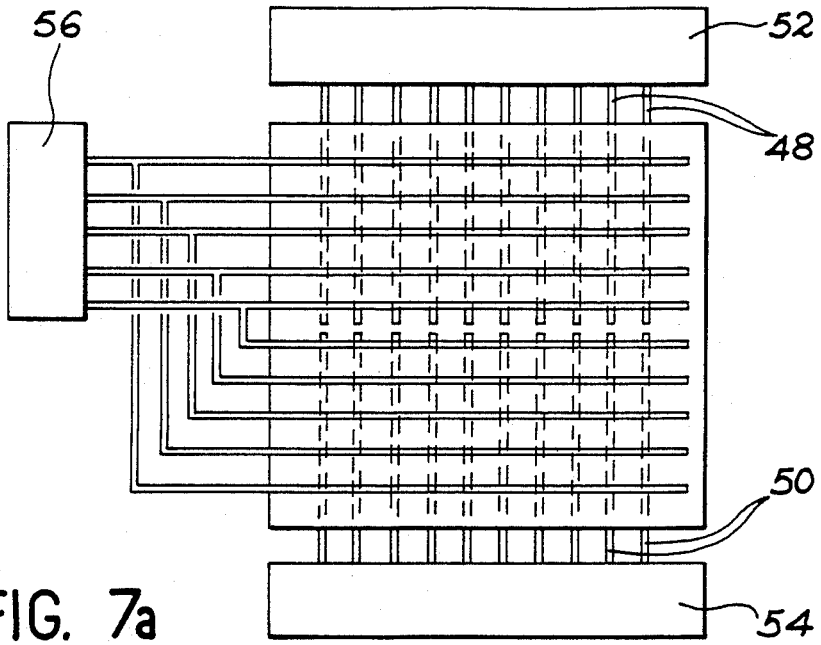
Figure 7B:
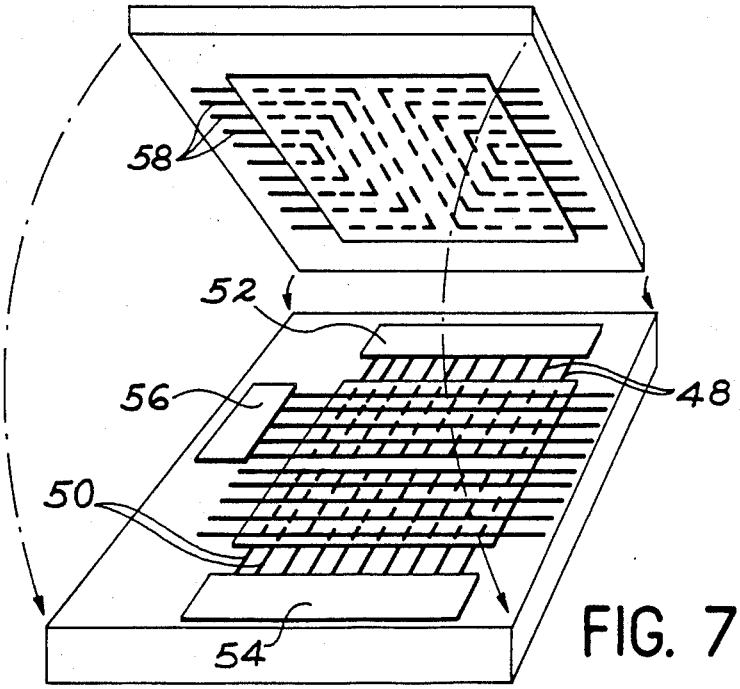

The invention can also be used for producing an electroluminescent screen comprising two layers of electroluminescent material having different colours. Such an electroluminescent screen is shown in FIG. 6. In this embodiment, the conventional counter-plate used for protecting the matrix of electroluminescent elements produced on the substrate is replaced by a second substrate, which itself carries a matrix of electroluminescent elements.

The two substrates 2A, 2B have a conventional structure and are identical, with regards to the matrix of electroluminescent elements. Each of them has a first group of parallel electrodes 4A, 4B, a layer 22A, 22B formed by two dielectric layers between which is arranged a layer of electroluminescent material and a second group of parallel electrodes 14A, 14B, the first and second groups intersecting.

The electroluminescent materials of the two substrates differ. Moreover, electrodes 14A, 14B are transparent, as are e.g. electrodes 4A, if display is to take place through substrate 2A.

Conductive studs 30A, 30B are located at the two ends of each of the electrodes 14A, 14B of the second groups of electrodes of each substrate.

The electroluminescent screen is completed by a control circuit 24A of the first group of electrodes 4A of substrate 2A, a control circuit 24B of the first group of electrodes 4B of substrate 2B and a control circuit 26 for controlling the second groups of electrodes 14A, 14B of substrates 2A, 2B.

Control circuit 24 can be produced on any one of the two substrates. In the embodiment of FIG. 6, it is produced on substrate 2A and is directly connected to the electrodes 14A of the second group of electrodes of said substrate. It is also connected to electrodes 14B of the second group of electrodes of substrate 2B via conductive studs 30A, 30B.

Finally, the electroluminescent screen comprises a not shown passivation layer to prevent an electrical contact between electrodes 4A and electrodes 4B and optionally circuits 24A and 24B, if the latter face one another, and a sealing band 20 for protecting the electroluminescent matrixes against ambient humidity.

The invention can also be advantageously used in large electroluminescent screens, in which the column electrodes are formed from two half-columns and the row electrodes are paired. Such a screen is shown in FIG. *7a*.

A screen with a slightly different structure, but based on the same principle of subdividing each column into two half-columns is described in the article "A large-area electroluminescent display", R. T. Flegal et al, SID 85 Digest, pp 213–214.

In this screen, each column electrode is formed from an upper half-column 48 and a lower half-column 50. The upper half-columns are addressed by a control circuit 52 and the lower half-columns by a control circuit 54.

The row electrodes are also subdivided into a subassembly of upper rows and a subassembly of lower rows, each row electrode of a subassembly being connected to a row electrode of the other subassembly.

For example, in FIG. *7a*, row electrode of rank i, $1 \leqq i \leqq N$, in which N is the number of rows of a subassembly, is connected to the electrode of rank $N-i+1$ of the other subassembly. The row electrodes are consequently controlled pairwise by a control circuit 56.

The connection between a row electrode of one subassembly and the corresponding row electrode of the other subassembly, which is diagrammatically shown in FIG. *7a*, can be carried out by means of counter-electrodes, which are etched in accordance with the invention on the counter-plate covering the matrix of electroluminescent elements.

Such counter-electrodes are shown in FIG. *7b*. These counter-electrodes 58 are shaped like a U nested in one another so as to connect each of the two ends of a row electrode of one subassembly to one of the ends of the row electrode of the other subassembly. In this way, each row electrode is electrically supplied by its two ends.

An advantage provided by the proposed arrangement as compared with that described in the article by R. T. Flegal is the economies with respect to the surface of the substrate carrying the electroluminescent structure, because the connections between the rows of different subassemblies are produced on the counter-plate.

What is claimed is:

1. A flat electroluminescent screen comprising a transparent substrate, a first group of parallel row electrodes etched on said substrate, said electrodes being transparent, a layer of an electroluminescent material inserted between two dielectric layers, a second group of parallel column electrodes etched on said dielectric layer, the two groups of electrodes intersecting and defining in the electroluminescent layer a plurality of matrix-arranged optical emitters, and a protective counter-plate sealed on said substrate, wherein the counter-plate carries on its inner face at least one counter-electrode and wherein means are provided so that each counter-electrode is electrically connected to the two ends of the same electrode of the first or second groups of electrodes.

2. A flat electroluminescent screen according to claim 1, wherein the protective counter-plate carries on its inner face a group of parallel counter-electrodes partly covered by an electrically insulating layer, each counter-electrode being connected to the two ends of an electrode of the first group of electrodes and is insulated from the electrodes of the second group of electrodes by said electrically insulating layer.

3. A flat electroluminescent screen according to claim 1, wherein the counter-plate carries on its inner face a group of parallel counter-electrodes, each counter-electrode being electrically connected to an electrode of the second group of electrodes.

4. A flat electroluminescent screen according to claim 1, wherein the counter-plate carries on its inner face a first group of counter-electrodes, an electrically insulating layer and a second group of counter-electrodes, the first and second groups of counter-electrodes intersecting, each counter-electrode of the first group of counter-electrodes being electrically connected to the two ends of an electrode of the first group of electrodes and each counter-electrode of the second group of counter-electrodes is electrically connected to the two ends of an electrode of the second group of electrodes.

5. A flat electroluminescent screen according to claim 1, wherein the electrical contact between an electrode and a counter-electrode is obtained, at each end of said electrode, by a conductive stud.

6. A flat electroluminescent screen according to claim 5, wherein each conductive stud is constituted by a conductive ink deposited by screen process printing.

7. A flat electroluminescent screen according to claim 5, wherein the conductive studs of two adjacent electrodes are reciprocally displaced.

8. A flat electroluminescent screen, wherein it comprises two substrates assembled with one another, each substrate carrying a first group of parallel electrodes, a plurality of layers constituting the electroluminescent elements and a second group of parallel electrodes, the electrodes of the first and second groups intersecting, the assembly of the substrates being realized in such a way as to electrically connect the two ends of an electrode of the second group of electrodes of a substrate to the two ends of an electrode of the second group of electrodes of the other substrate, said screen also comprising a control circuit for controlling the electrodes of the first group of electrodes of a substrate, a control circuit for controlling the electrodes of the first group of electrodes of the other substrate and a control circuit for controlling the electrodes of the second groups of electrodes of the two substrates.

9. A flat electroluminescent screen comprising a transparent substrate on which are successively deposited a group of parallel row electrodes constituted by two row electrode subassemblies, said electrodes being transparent and each row electrode of a subassembly being paired with a row electrode of the other subassembly, an electroluminescent material layer inserted between two dielectric layers and a group of parallel column electrodes, each column being formed by two half-columns, each half-column intersecting a row subassembly, said flat screen also comprising a row control circuit and two half-column control circuits, said screen also comprising a protective counter-plate sealed on said substrate by a sealing band, wherein the counter-plate carries on its inner face a group of counter-electrodes and wherein means are provided for electrically connecting via a counter-electrode each end of a row electrode to one end of the row electrode with which it is paired.

* * * * *